US012723796B2

(12) United States Patent
Nakano et al.

(10) Patent No.: US 12,723,796 B2
(45) Date of Patent: Sep. 1, 2026

(54) GAS AMOUNT ESTIMATION APPARATUS, GAS PROCESSING APPARATUS, TRANSPORTATION CONTAINER, GAS AMOUNT ESTIMATION METHOD, AND PROGRAM

(71) Applicant: DAIKIN INDUSTRIES, LTD., Osaka (JP)

(72) Inventors: Masataka Nakano, Osaka (JP); Kiichiro Sato, Osaka (JP); Motomi Nishimoto, Osaka (JP); Hidenori Matsui, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 236 days.

(21) Appl. No.: 18/692,520

(22) PCT Filed: Sep. 27, 2022

(86) PCT No.: PCT/JP2022/036011
§ 371 (c)(1),
(2) Date: Mar. 15, 2024

(87) PCT Pub. No.: WO2023/054392
PCT Pub. Date: Apr. 6, 2023

(65) Prior Publication Data

US 2024/0384917 A1 Nov. 21, 2024

(30) Foreign Application Priority Data

Sep. 30, 2021 (JP) ..... 2021-160698

(51) Int. Cl.
*F25D 17/04* (2006.01)
*F25D 11/00* (2006.01)

(52) U.S. Cl.
CPC ..... *F25D 17/042* (2013.01); *F25D 11/003* (2013.01)

(58) Field of Classification Search
CPC ..... F25D 14/042; F25D 11/003
See application file for complete search history.

(56) References Cited

U.S. PATENT DOCUMENTS 4,894,997 A 1/1990 Urushizaki et al.
2023/0138886 A1* 5/2023 Tanno ..... F25D 29/003 706/12

FOREIGN PATENT DOCUMENTS

JP S54-072099 6/1979
JP S63-283539 11/1988
(Continued)

OTHER PUBLICATIONS

JP-2019041601-A translation.*
(Continued)

*Primary Examiner* — Elizabeth J Martin
(74) *Attorney, Agent, or Firm* — IPUSA, PLLC

(57) ABSTRACT

An object of the present disclosure is to optimize the injection amount of the CA gas to be injected into a transportation means such as a truck, to maintain the freshness of perishable products during transportation above a predetermined level.
Accordingly, the present disclosure discloses a gas amount estimation apparatus including a control unit, wherein the control unit is configured to set, as input data, information relating to a type and an amount of a perishable product stored in a CA refrigerator, and estimate a supply amount or a processing amount of CA gas with respect to the CA refrigerator in a predetermined time and set the estimated supply amount or the estimated processing amount as output
(Continued)

data. Thus, the freshness of the perishable products during transportation can be maintained above a predetermined level.

14 Claims, 9 Drawing Sheets

(56) References Cited

FOREIGN PATENT DOCUMENTS

| | | | |
|---|---|---|---|
| JP | H09-172959 | | 7/1997 |
| JP | 2017-227370 | | 12/2017 |
| JP | 2019-041601 | | 3/2019 |
| JP | 2019041601 A | * | 3/2019 |

OTHER PUBLICATIONS

Extended European search report mailed on Sep. 8, 2025 with respect to the corresponding EP patent application No. 22876258.9.
International Preliminary Report on Patentability for PCT/JP2022/036011 mailed on Apr. 11, 2024.
International Search Report for PCT/JP2022/036011 mailed on Dec. 13, 2022.

* cited by examiner

GAS AMOUNT ESTIMATION APPARATUS, GAS PROCESSING APPARATUS, TRANSPORTATION CONTAINER, GAS AMOUNT ESTIMATION METHOD, AND PROGRAM

TECHNICAL FIELD

The present disclosure relates to a gas amount estimation apparatus, a gas processing apparatus, a transportation container, a gas amount estimation method, and a program.

BACKGROUND ART

In recent years, regional specialties of rural areas have been transported to destinations such as urban areas to revitalize rural areas. When regional specialties are perishable products, the regional specialties may be transported by air shipment in order to maintain the freshness of the regional specialties above a certain level, but because of the high cost of transportation, surface transportation by sea shipment or by trucks is the main means of transportation. When perishable products are produced on a remote island without an airport, it may take more than ten days to transport the perishable products to the destination.

On the other hand, in order to maintain the freshness of perishable products above a certain level, there is disclosed a technology of a controlled atmosphere (CA) gas refrigerator that maintains the freshness of perishable products above a certain level by refrigeration and CA gas (see Patent Document 1). Therefore, if a truck or the like equipped with a CA gas refrigerator is used for transportation of perishable products, it is possible to maintain the freshness of perishable products above a certain level while reducing transportation costs even if the transportation time increases.

CITATION LIST

Patent Document

[Patent document 1] Japanese Unexamined Patent Application Publication No. S54-72099

SUMMARY OF INVENTION

Technical Problem

However, when CA gas is injected into a truck or the like, it is unclear what amount of CA gas needs to be processed during transportation, such as the amount of CA gas to be supplied or removed. Therefore, when the injected CA gas is insufficient, the freshness of perishable products cannot be maintained above a certain level. Further, although relatively large amounts of CA gas may be injected, a problem arises that a gas processing apparatus such as a CA gas cylinder becomes large and the amount of perishable products that can be transported becomes small.

Considering the above circumstances, an object of the present disclosure is to optimize the injection amount of the CA gas.

Solution to Problem

A first aspect of the present disclosure is a gas amount estimation apparatus including a control unit, wherein the control unit is configured to set, as input data, information relating to a type and an amount of a perishable product stored in a controlled atmosphere (CA) refrigerator, and estimate a supply amount or a processing amount of CA gas with respect to the CA refrigerator in a predetermined time and set the estimated supply amount or the estimated processing amount as output data.

According to the first aspect, the injection amount of CA gas can be optimized.

A second aspect of the present disclosure is the gas amount estimation apparatus according to the first aspect, wherein the control unit calculates the supply amount or the processing amount of the CA gas by using a result obtained by learning, by machine learning, a relationship between the input data, which is the information relating to the type and the amount of the perishable product stored in the CA refrigerator, and a true supply amount or a true processing amount of the CA gas.

According to the second aspect, the injection amount of the CA gas can be optimized by using the result learned by machine learning.

A third aspect of the present disclosure is the gas amount estimation apparatus according to the first aspect, wherein the control unit calculates the supply amount or the processing amount of the CA gas by using table data indicating a relationship between the input data, which is the information relating to the type and the amount of the perishable product stored in the CA refrigerator, and a true supply amount or a true processing amount of the CA gas.

According to the third aspect, the CA gas injection amount can be optimized by using table data.

A fourth aspect of the present disclosure is the gas amount estimation apparatus according to any one of the first to third aspects, wherein the input data includes a temperature or a humidity inside the CA refrigerator during transportation of the perishable product, and the control unit further estimates the supply amount or the processing amount of the CA gas based on the temperature or the humidity.

According to the fourth aspect, the CA gas injection amount can be optimized with higher accuracy by including the temperature or humidity in the CA refrigerator during the transportation of the perishable product in the input data.

A fifth aspect of the present disclosure is the gas amount estimation apparatus according to any one of the first to third aspects, wherein the control unit further estimates the supply amount or the processing amount of the CA gas based on a transportation time of the perishable product.

According to the fifth aspect, by considering the transportation time of the perishable product, the injection amount of the CA gas can be optimized with higher accuracy even when the transportation time is relatively long.

The sixth aspect of the present disclosure is the gas amount estimation apparatus according to any one of the first to fifth aspects, wherein the output data includes the supply amount of the CA gas supplied to the CA refrigerator to maintain the CA gas in the CA refrigerator at a predetermined concentration during transportation of the perishable product, or a removal amount of the CA gas removed from the CA refrigerator to maintain the CA gas in the CA refrigerator at the predetermined concentration during the transportation of the perishable product, and the control unit estimates the supply amount of the CA gas when the supply amount of the CA gas is included in the output data, or estimates the removal amount within the processing amount of the CA gas when the removal amount of the CA gas is included in the output data.

According to the sixth aspect, the CA gas injection amount can be optimized with higher accuracy by estimating the CA gas supply amount or removal amount.

The seventh aspect of the present disclosure is the gas amount estimation apparatus according to any one of the first to fifth aspects, wherein the control unit calculates a number of gas amount control apparatuses configured to control a gas amount of the CA gas in each of a plurality of the CA refrigerators based on the type and the amount of the perishable product, according to the supply amount or the processing amount of the CA gas in each of the plurality of the CA refrigerators.

According to the seventh aspect, even in the case of transportation by the plurality of CA refrigerators, the number of gas amount control apparatuses for controlling the gas amount of CA gas in each of the plurality of CA refrigerators can be calculated.

An eighth aspect of the present disclosure is the gas amount estimation apparatus according to any one of the first to seventh aspects, wherein the output data is data relating to oxygen, carbon dioxide, nitrogen, or ethylene.

According to the eighth aspect, the case where the output data is oxygen, carbon dioxide, nitrogen, or ethylene can also be accommodated.

A ninth aspect of the present disclosure is a gas processing apparatus configured to process the CA gas with respect to the CA refrigerator, wherein a predetermined amount of the CA gas is injected in the gas processing apparatus based on the supply amount or the processing amount of the CA gas estimated by the gas amount estimation apparatus according to any one of the first to fifth aspects.

According to the ninth aspect, a gas processing apparatus such as a CA gas cylinder in which the injection amount of CA gas is optimized can be prepared.

A tenth aspect of the present disclosure is a transportation container including the gas processing apparatus according to the ninth aspect.

According to the tenth aspect, a transportation container equipped with a gas processing apparatus such as a CA gas cylinder in which the injection amount of CA gas is optimized can be prepared.

An eleventh aspect of the present disclosure is the transportation container according to the tenth aspect, further including:

a gas amount control apparatus configured to control a gas amount of the CA gas in the CA refrigerator based on the type and the amount of the perishable product.

According to the eleventh aspect, a gas processing apparatus such as a CA gas cylinder in which the injection amount of CA gas is optimized based on the type and the amount of the perishable product can be prepared.

A twelfth aspect of the present disclosure is a gas amount estimation method executed by a computer, the gas amount estimation method including:

setting, as input data, information relating to a type and an amount of a perishable product stored in a CA refrigerator; and estimating a supply amount or a processing amount of CA gas with respect to the CA refrigerator in a predetermined time and setting the estimated supply amount or the estimated processing amount as output data.

According to the twelfth aspect, the injection amount of CA gas can be optimized.

A thirteenth aspect of the present disclosure is the gas amount estimation method according to the twelfth aspect, wherein the computer calculates the supply amount or the processing amount of the CA gas by using a result obtained by learning, by machine learning, a relationship between the input data, which is the information relating to the type and the amount of the perishable product stored in the CA refrigerator, and a true supply amount or a true processing amount of the CA gas.

According to the thirteenth aspect, the injection amount of CA gas can be optimized by using the result of machine learning.

A fourteenth aspect of the present disclosure is the gas amount estimation method according to the twelfth aspect, wherein the computer calculates the supply amount or the processing amount of the CA gas by using table data indicating a relationship between the input data, which is the information relating to the type and the amount of the perishable product stored in the CA refrigerator, and a true supply amount or a true processing amount of the CA gas.

According to the fourteenth aspect, the injection amount of CA gas can be optimized by using table data.

A fifteenth aspect of the present disclosure is a program that causes a computer to execute the gas amount estimation method according to any one of the twelfth to fourteenth aspects.

According to the fifteenth aspect, the injection amount of CA gas can be optimized.

DESCRIPTION OF EMBODIMENTS

Embodiments of the present invention will now be described with reference to FIGS. 1 to 9.

Outline of Embodiment

In general, the freshness retention period can be greatly extended by adjusting the composition (oxygen concentration, carbon dioxide concentration, nitrogen concentration, ethylene concentration, etc.) of the air in the refrigerator (storage), and reducing the respiration action of perishable products such as fruit and vegetables to prevent the consumption of sugars and acids contained in the perishable products. This is referred to as controlled atmosphere (CA) storage, and is one of the storage methods for perishable products. There are two types of CA: a "passive type", which adjusts the composition of air in the refrigerator by using the respiration action of perishable products, and an "active type", which adjusts the composition of air in the refrigerator by supplying nitrogen gas or the like to the refrigerator. In the present embodiment, a particular case of implementing the active type will be described. Hereinafter, the gas which is supplied and/or removed in order to adjust the composition of air in the refrigerator will be collectively referred to as "CA gas".

Figure 1:
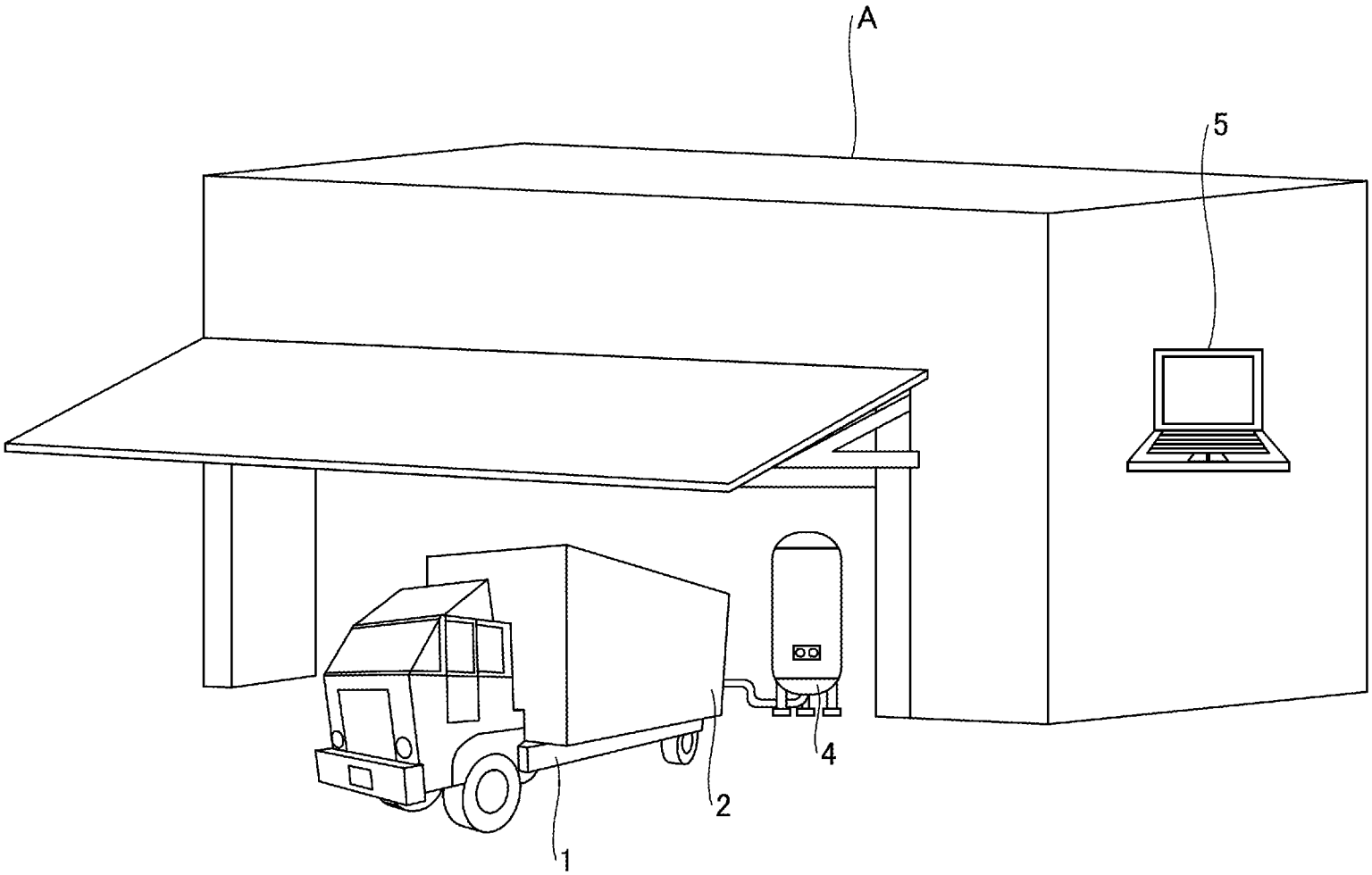
FIG. 1 is a schematic diagram of a transportation company where a gas amount estimation apparatus according to an embodiment of the present invention is installed.

FIG. 1 is a schematic diagram of a transportation company where a gas amount estimation apparatus according to an embodiment of the present invention is installed. In FIG. 1, a truck 1 for transportation before departure is parked at a transportation company A. The truck 1 is equipped with a transportation container 2 (the transportation container is hereinafter referred to as "container".) for storing products (here, perishable products). The transportation company A is also equipped with a gas injection apparatus 4 for storing CA gas to be injected into a CA gas cylinder 104*a* provided in the container 2. The transportation company A is also equipped with a gas amount estimation apparatus 5. The gas amount estimation apparatus 5 is an example of a computer that estimates the amount of CA gas that needs to be supplied and removed to maintain the freshness of perishable products based on the transportation time of the truck 1. The gas amount estimation apparatus 5 may estimate the amount of CA gas to be supplied or removed.

Figure 2:
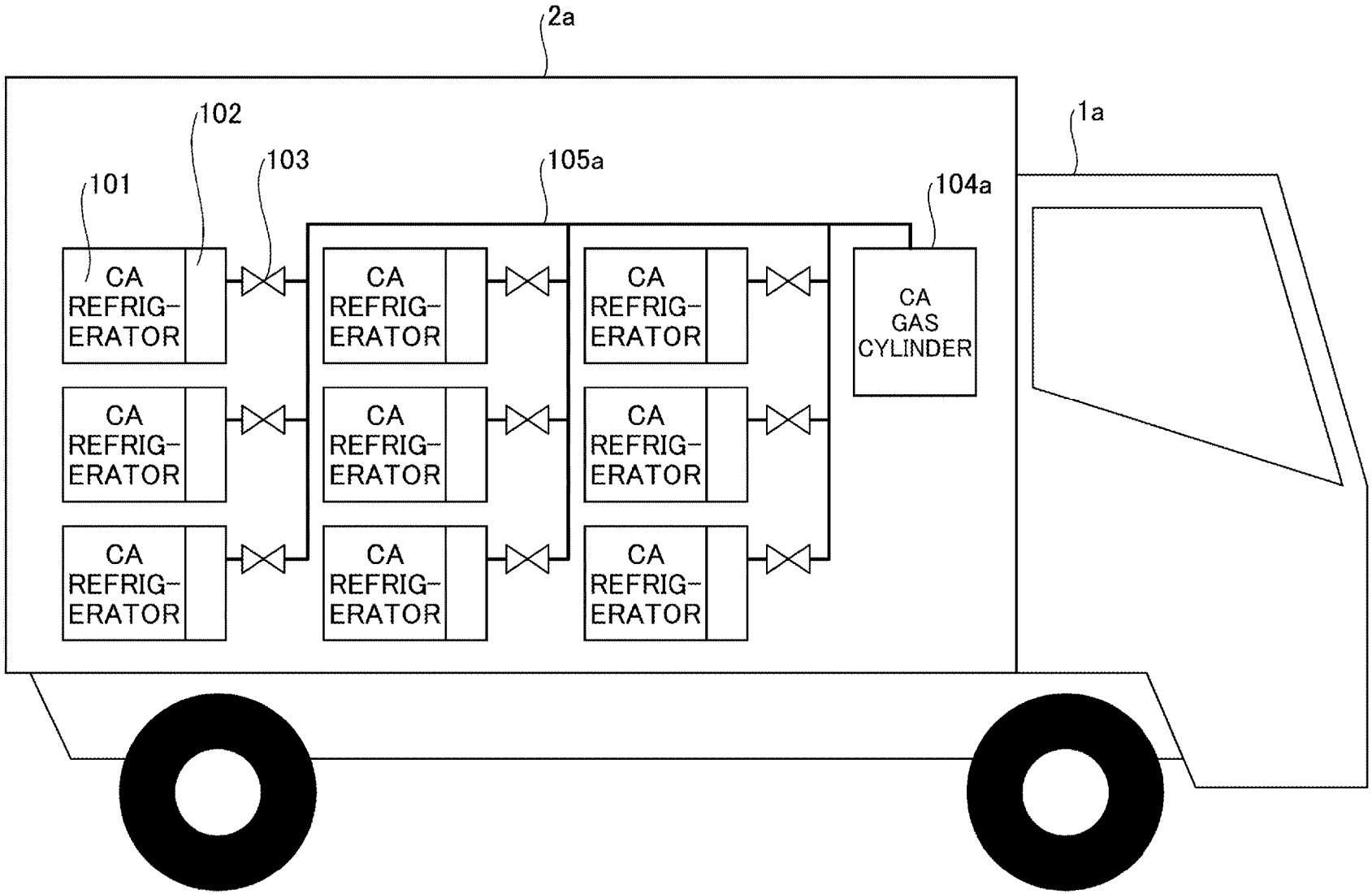
FIG. 2 is a schematic diagram of a truck according to the present embodiment.

FIG. 2 is a schematic diagram of a truck of the present embodiment. A truck 1*a* illustrated in FIG. 2 is an example of the truck 1 of FIG. 1. A container 2*a* mounted on the truck 1*a* is provided with a plurality of sets of a CA refrigerator 101, a CA refrigeration unit 102, and a valve 103. In FIG. 2, for convenience of explanation, only one set (a CA refrigerator, a CA refrigeration unit, and a valve) is denoted by reference numerals. Further, the container 2*a* is provided with a CA gas cylinder 104*a* and a CA gas pipe 105*a*.

The CA refrigerator 101 is a refrigerator that is highly airtight, has thermal insulation properties, and can maintain freshness of perishable products above a certain level by refrigeration and CA gas. Different kinds of perishable products are stored in each of the CA refrigerators 101. For example, avocados that are perishable products respire significantly, so to keep avocados fresh, $CO_2$ needs to be removed from the CA refrigerator 101, and nitrogen needs to be supplied instead in the CA refrigerator 101. Fruit that respire less do not require such processing. The environment and situation in the stored CA refrigerator 101 differ depending on the type of perishable products, and, therefore, different kinds of perishable products are stored separately in each of the CA refrigerators 101.

The CA refrigeration unit 102 is an example of a gas amount control apparatus for controlling the temperature and humidity in the CA refrigerator 101 and controlling the CA gas. The valve 103 adjusts the gas amount of CA gas supplied from the CA gas cylinder 104*a* through the CA gas pipe 105*a* by driving control by the CA refrigeration unit 102.

The CA gas cylinder 104*a* stores a predetermined amount of CA gas injected from the gas injection apparatus 4 based on the amount of CA gas to be supplied and removed estimated by the gas amount estimation apparatus 5 in FIG. 1. The CA gas cylinder 104*a* may store a predetermined amount of CA gas injected from the gas injection apparatus 4 based on the amount of CA gas to be supplied or removed estimated by the gas amount estimation apparatus 5. The CA gas cylinder 104*a* is an example of a gas processing apparatus. The gas processing apparatus includes a CA gas generation apparatus that generates CA gas. The CA gas generation apparatus separates air components in the atmosphere and supplies CA gas. The CA gas pipe 105*a* is used to supply CA gas from the CA gas cylinder 104*a* to the CA refrigeration unit 102.

[Hardware Configuration]

<Hardware Configuration of CA Refrigeration Device>

Figure 3:
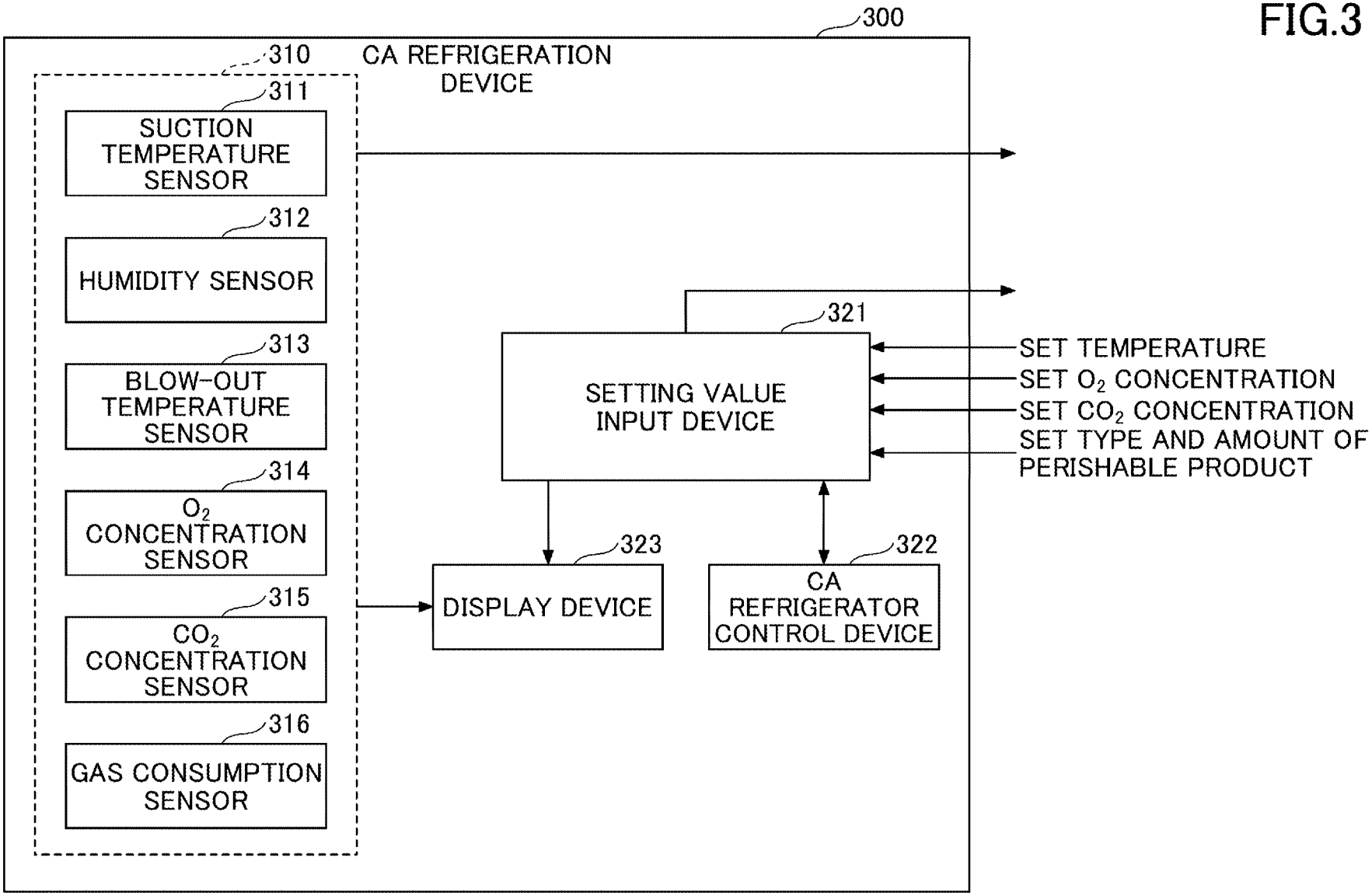
FIG. 3 is a hardware configuration diagram of the CA refrigeration device according to the present embodiment.

FIG. 3 is a hardware configuration diagram of a CA refrigeration device of the present embodiment. A CA refrigeration device 300 is provided in each CA refrigeration unit 102 of FIG. 2. The CA refrigeration device 300 is provided in the container 2*a* and may perform processing on each CA refrigeration unit 102.

The CA refrigeration device 300 is provided with a sensor group 310 for detecting the environment and situation of the CA refrigerator 101 in the same set. The sensor group 310 includes, for example, a suction temperature sensor 311, a humidity sensor 312, a blow-out temperature sensor 313, an $O_2$ (oxygen) concentration sensor, a $CO_2$ (carbon dioxide) concentration sensor, and a gas consumption sensor 316, as illustrated in FIG. 3.

Among these, the suction temperature sensor 311 is a sensor for detecting the temperature of a gas suctioned into the CA refrigerator 101. The humidity sensor 312 is a sensor for detecting the humidity in the CA refrigerator 101. The blow-out temperature sensor 313 is a sensor for detecting the temperature of a gas blown out from the CA refrigerator 101. The $O_2$ concentration sensor is a sensor for detecting the concentration of $O_2$ in the CA refrigerator 101. The $CO_2$ concentration sensor is a sensor for detecting the concentration of $CO_2$ in the CA refrigerator 101. The gas consumption sensor 316 is a sensor for detecting the consumption of CA gas in the CA refrigerator 101. The sensor group 310 may include a nitrogen concentration sensor for detecting the nitrogen concentration in the CA refrigerator 101 or an ethylene concentration sensor for detecting the ethylene concentration in the CA refrigerator 101.

The CA refrigeration device 300 is provided with a setting value input device 321, a CA refrigerator control device 322, and a display device 323.

Among these, the setting value input device 321 is a device for inputting each setting value of the environment and the situation in the CA refrigerator 101 by a user (such as a truck driver). For example, as illustrated in FIG. 3, the setting values are the set temperature, the set $O_2$ concentration, the set $CO_2$ concentration, and the set type and the set amount of perishable products. Hereinafter, "setting type and setting amount" will be referred to as "setting type and amount". The setting value may include the set nitrogen concentration or the set ethylene concentration, as long as the setting type and amount of perishable products are included.

The CA refrigerator control device 322 controls the temperature and humidity in the CA refrigerator 101 based on each setting value input to the setting value input device 321. The CA refrigerator control device 322 may control the temperature or humidity in the CA refrigerator 101.

The display device 323 displays each setting value input to the setting value input device 321 and displays the detection result of the sensor group 310. The display device 323 is provided with a display for displaying the setting value and the detection result.

<Hardware Configuration of Gas Amount Estimation Apparatus>

Figure 4:
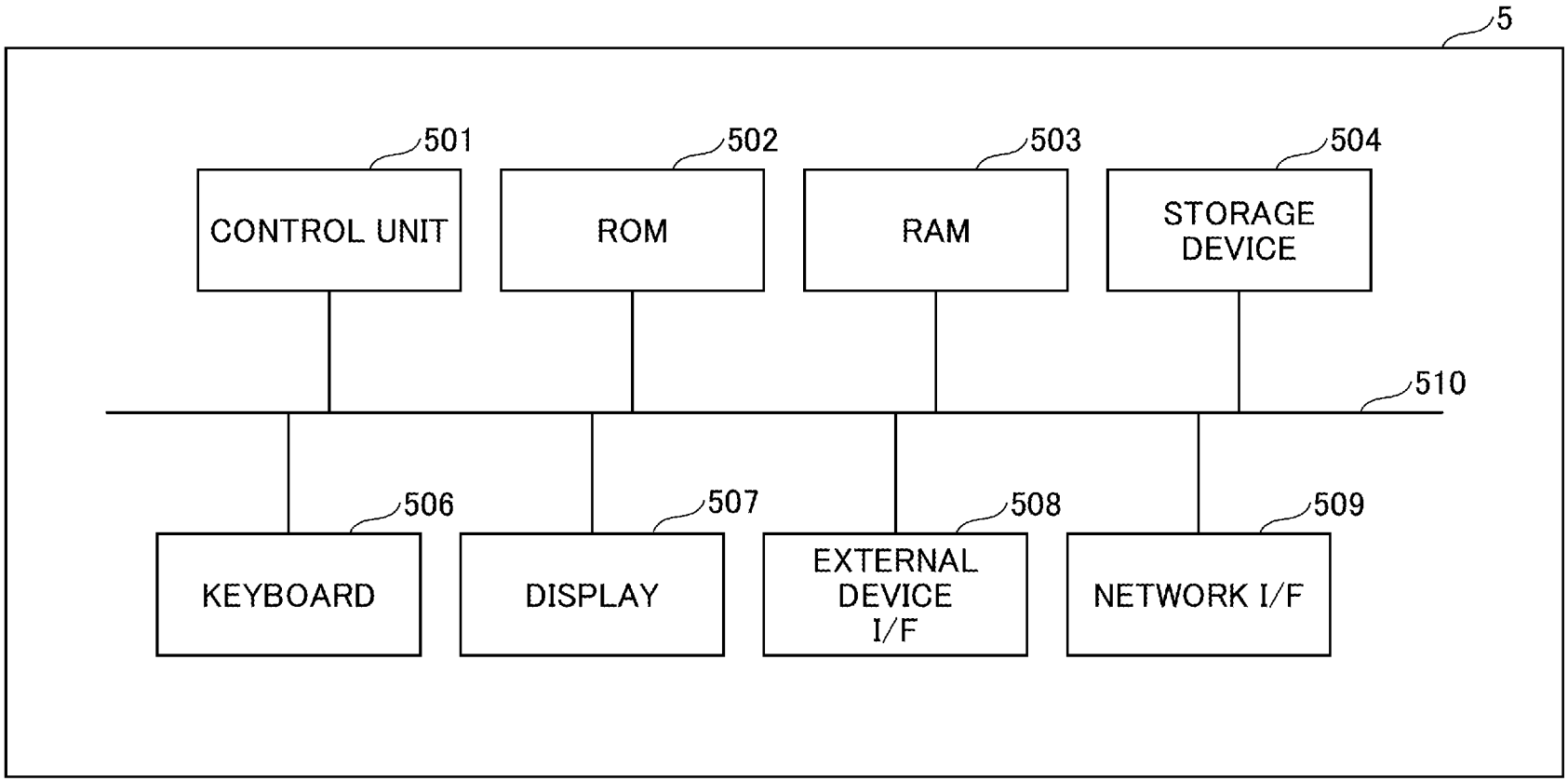
FIG. 4 is a hardware configuration diagram of the gas amount estimation apparatus according to the present embodiment.

FIG. 4 is a hardware configuration diagram of the gas amount estimation apparatus according to the present embodiment. FIG. 4 is a hardware configuration diagram of the gas amount estimation apparatus. As illustrated in FIG. 4, the gas amount estimation apparatus 5 includes a control unit 501, a ROM (Read Only Memory) 502, a RAM (Random Access Memory) 503, a storage device 504, a keyboard 506, a display 507, an external device I/F (interface) 508, a network I/F 509, and a bus line 510.

Among these, the control unit 501 is configured by a CPU (Central Processing Unit), but may include a GPGPU (General-purpose computing on graphics processing units). The control unit 501 controls the operation of the entire gas amount estimation apparatus 5.

The ROM 502 stores a program used for the processing of the control unit 501. The RAM 503 is used as a work area of the control unit 501.

The storage device 504 is configured by a solid state drive (SSD), a hard disk drive (HDD), or a flash memory. The storage device 504 reads or writes various kinds of data, such as a program executed by the gas amount estimation apparatus, in accordance with the control by the control unit 501. The various kinds of data include a data set for machine learning. The data set for machine learning in the present embodiment is data correlated to the gas consumption amount when driving the CA refrigeration device 300 and gas amount data indicating the gas consumption amount when driving the CA refrigeration device 300. These kinds of data will be described in detail later.

The keyboard 506 is a type of input means having a plurality of keys for inputting characters, numbers, various instructions, etc.

The display 507 is a type of display means such as a liquid crystal or an organic EL (Electro Luminescence) for displaying data, images, various icons, etc.

The external device I/F 508 is an interface for connecting various external devices. The external devices in this case are an external display as an example of a display means, a mouse, keyboard, or microphone as an example of an input means, a printer or speaker as an example of an output means, and a USB (Universal Serial Bus) memory as an example of a storage means.

The network I/F 509 performs data communication with an operation terminal or a server other than the gas amount estimation apparatus 5 via a communication network such as the Internet.

Figure 5:
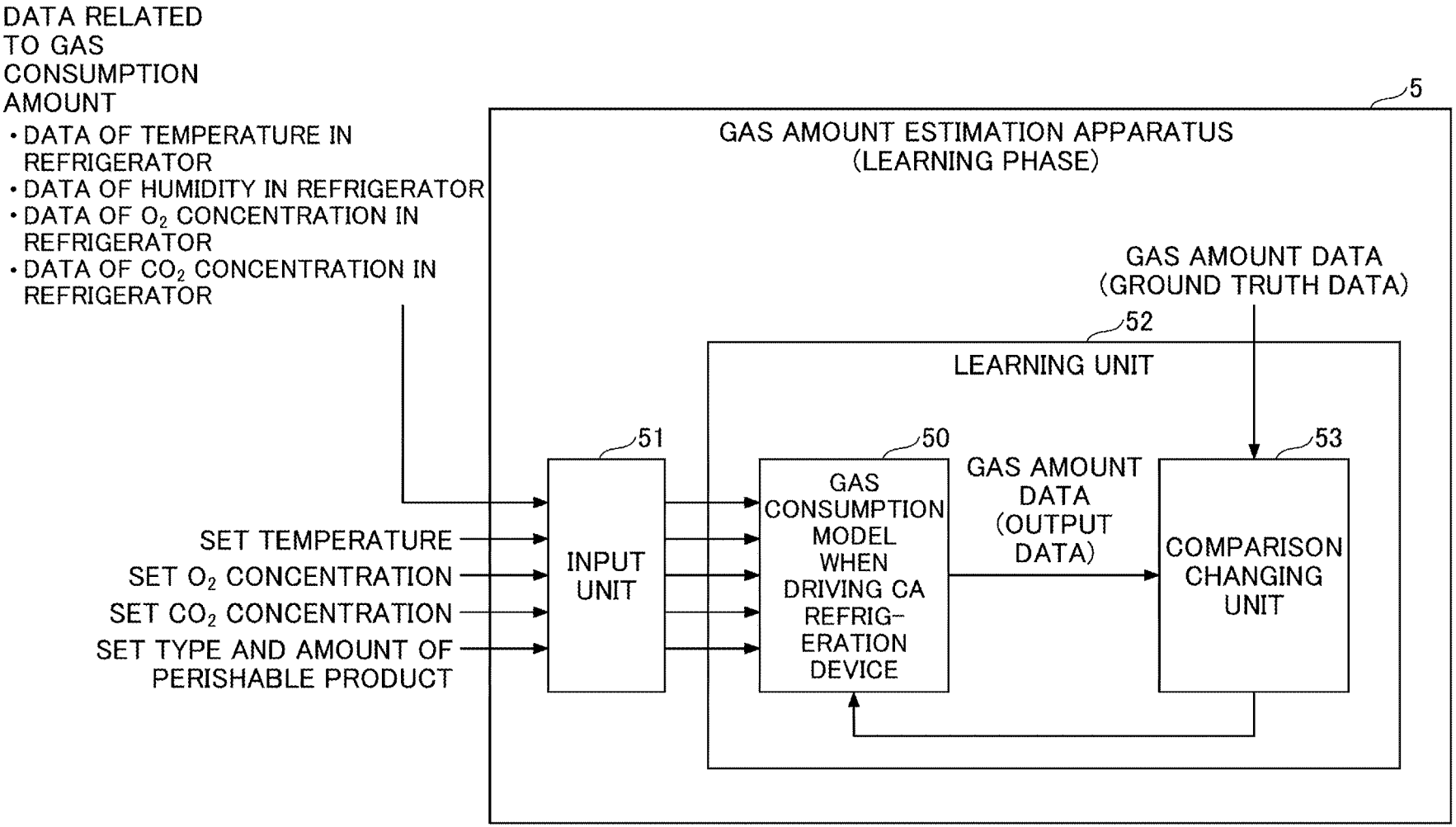
FIG. 5 is a functional block diagram of the gas amount estimation apparatus in the learning phase.

The bus line 510 is an address bus, a data bus, or the like for electrically connecting the elements such as the control unit 501 illustrated in FIG. 5.

[Functional Configuration]

<Learning Phase>

FIG. 5 is a functional block diagram of the gas amount estimation apparatus in the learning phase. As illustrated in FIG. 5, the gas amount estimation apparatus 5 in the learning phase has an input unit 51 and a learning unit 52. These units are functions implemented by an instruction from the control unit 501 in FIG. 4 based on a program.

The input unit 51 inputs data related to the gas consumption amount in the CA refrigerator 101 from the sensor group 310 in FIG. 3. The data related to the gas consumption amount includes data of the temperature in the refrigerator, data of the humidity in the refrigerator, data of the $O_2$ concentration in the refrigerator, data of the $CO_2$ concentration in the refrigerator, and the like. The data related to the gas consumption amount may be at least one piece of data of the temperature in the refrigerator, data of the humidity in the refrigerator, data of the $O_2$ concentration in the refrigerator, or data of the $CO_2$ concentration in the refrigerator. For example, the data related to the gas consumption amount may be data of the $O_2$ concentration in the refrigerator or data of the $CO_2$ concentration in the refrigerator.

Further, the input unit 51 inputs data of each setting value of the set temperature, the set $O_2$ concentration, the set $CO_2$ concentration, and the set type and amount of the perishable product from the setting value input device 321. Among the data of each setting value of the set temperature, the set $O_2$ concentration, the set $CO_2$ concentration, and the set type and amount of the perishable product, the input unit 51 may input data of at least the set type and amount of the perishable product. For example, the input unit 51 may input data on the set $O_2$ concentration or the set $CO_2$ concentration in addition to the data on the set type and amount of the perishable product.

In the learning phase, the gas amount estimation apparatus 5 inputs each piece of output data (data related to the gas consumption amount, set temperature data, etc.) after transportation from a storage device storing each piece of output data of the CA refrigeration device 300 mounted on the truck 1*a*. The gas amount estimation apparatus 5 may be mounted on the truck 1*a* without being installed in the transportation company A, and the gas amount estimation apparatus 5 may directly input each piece of output data (data related to the gas consumption amount, set temperature data, etc.) during transportation.

The learning unit 52 has a machine learning model and generates a machine learning model capable of outputting information with high accuracy by machine learning using a machine learning algorithm such as a neural network. The machine learning model of the present embodiment is a gas consumption model 50 at the time of the operation of the CA refrigeration device. For example, the learning unit 52 sets, as input data, at least information on the type and amount of perishable products stored in the CA refrigerator 101, and sets, as output data, the amount of CA gas supplied to and removed from the CA refrigerator 101 at a predetermined time. The output data is data on oxygen, carbon dioxide, nitrogen, or ethylene.

Further, the learning unit 52 has a comparison changing unit 53, which compares the gas amount data as output data output from the gas consumption model 50 at the time of the operation of the CA refrigeration device, with the true gas amount data (data of the supply amount or the processing amount of the CA gas) as ground truth data, and changes the model parameters of the gas consumption model 50 at the time of the operation of the CA refrigeration device according to the error. Thus, the learning unit 52 performs machine learning of the gas consumption model 50 at the time of the operation of the CA refrigeration device, and can generate the learned gas consumption model 60 at the time of the operation of the CA refrigeration device described later.

<Estimation Phase>

Figure 6:
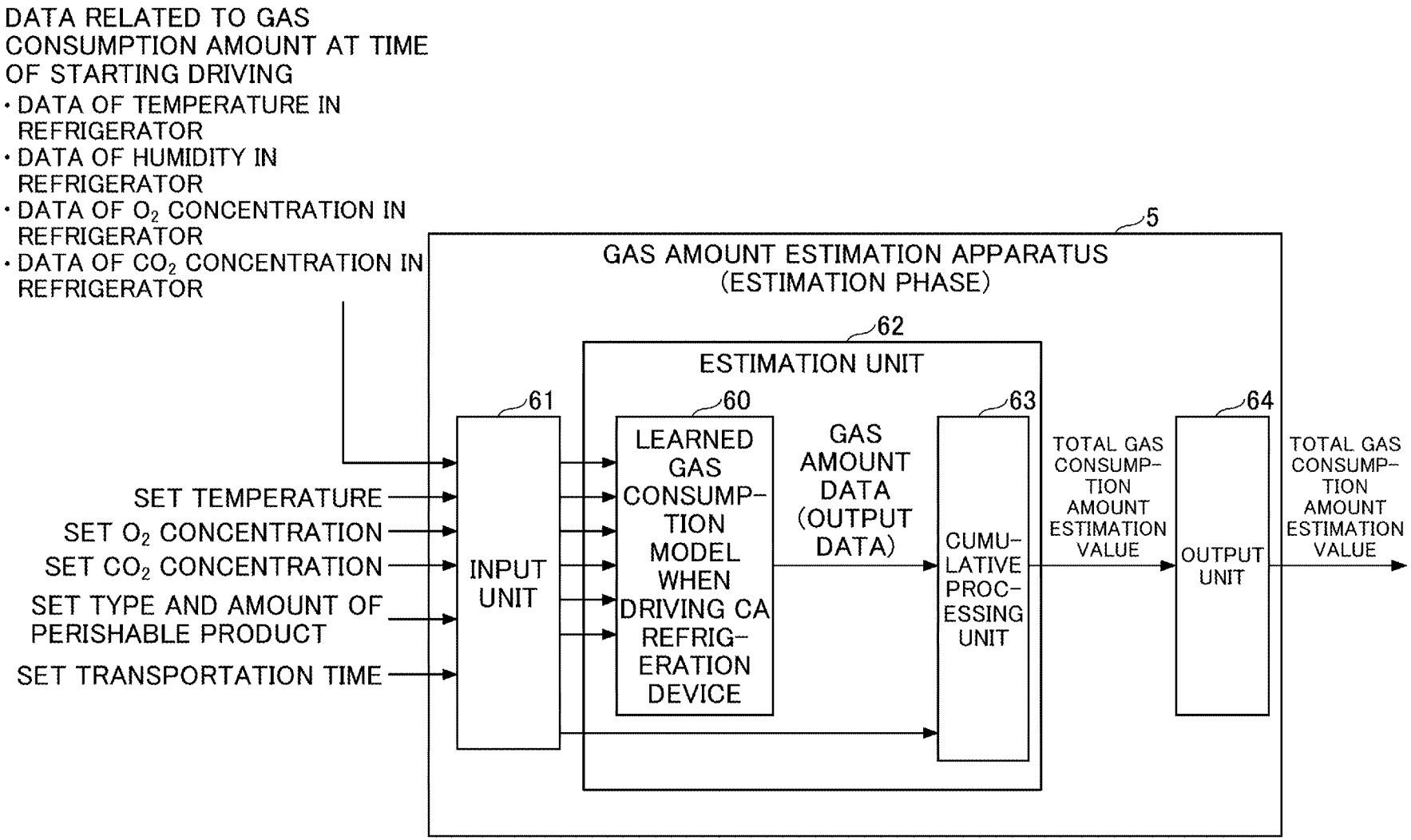
FIG. 6 is a functional block diagram of the gas amount estimation apparatus in the estimation phase.

FIG. 6 is a functional block diagram of the gas amount estimation apparatus in the estimation phase. As illustrated in FIG. 6, the gas amount estimation apparatus 5 in the estimation phase has an input unit 61, an estimation unit 62, and an output unit 64. These units are functions implemented by an instruction by the control unit 501 in FIG. 4 based on a program.

The gas amount estimation apparatus 5 can acquire each piece of data from the CA refrigeration device 300 in a wired or wireless manner before the truck 1*a* departs from the transportation company A. When the CA refrigerator 101 starts driving before the truck 1*a* departs from the transportation company A, the input unit 51 inputs data related to the gas consumption amount at the start of driving from the sensor group 310 of FIG. 3. The data related to the gas consumption amount at the start of the driving includes data of the temperature in the refrigerator, data of the humidity in the refrigerator, data of the $O_2$ concentration in the refrigerator, data of the $CO_2$ concentration in the refrigerator, and the like. Basically, the types of data related to the gas consumption amount at the start of the driving in the estimation phase (data of temperature in the refrigerator, etc.) are the same as the types of data related to the gas consumption amount in the learning phase.

Further, the input unit 51 inputs data of each setting value of the set temperature, the set $O_2$ concentration, the set $CO_2$ concentration, and the set type and amount of the perishable product from the setting value input device 321, and further inputs data of the set transportation time as the setting value. Basically, the types of the setting values (set temperature, etc.) in the estimation phase are the same as the types of the setting values in the learning phase.

The estimation unit 62 has a gas consumption model 60 generated by the learning unit 52 when the CA refrigeration device is driven. For example, the estimation unit 62 sets at least the information on the type and amount of perishable product stored in the CA refrigerator 101 as input data, and estimates the amount of CA gas supplied to and removed from the CA refrigerator 101 at a predetermined time and sets these amounts as output data. The estimation unit 62 may estimate the amount of CA gas supplied or removed. Specifically, the estimation unit 62 estimates the amount of CA gas supplied when the output data includes the amount of CA gas supplied, or estimates the amount of CA gas removed when the output data includes the amount of CA gas removed.

The estimation unit 62 further includes a cumulative processing unit 63. The cumulative processing unit 63 calculates the total gas consumption amount estimation value of the set transportation time based on the gas amount data, which is the output data acquired from the learned gas consumption model 60 when the CA refrigeration device is driven, and the data of the set transportation time data acquired from the input unit 61. The total gas consumption amount estimation value is an estimation value of the supply amount and the removal amount of the CA gas. When there are multiple CA refrigerators 101, the cumulative processing unit 63 calculates the total gas consumption amount estimation value for each CA refrigerator. The total gas consumption amount estimation value may be an estimation value of the amount of CA gas supplied or removed. For example, if the gas amount data that is the output data indicates the amount of CA gas supplied or removed, the total gas consumption amount estimation value may be an estimation value of at least one of the amount of CA gas supplied or removed. If the gas amount data that is the output data indicates the amount of CA gas supplied, the total gas consumption amount estimation value may be an estimation value of the amount of CA gas supplied. If the gas amount data that is the output data indicates the amount of CA gas removed, the total gas consumption amount estimation value may be an estimation value of the amount of CA gas removed. The amount of CA gas removed is an example of the amount of CA gas processed.

Further, the cumulative processing unit 63 may calculate the number of CA refrigeration units 102 for controlling the amount of CA gas in each of the plurality of CA refrigerators 101 based on the type and amount of the perishable product in accordance with the amount of CA gas supplied or processed in each of the plurality of CA refrigerators 101.

The output unit 64 acquires the total gas consumption amount estimation value calculated by the cumulative processing unit 63 and outputs the total gas consumption amount estimation value to the display 507 or the above-mentioned external device via the external device I/F 508.

[Processing or Operation of Embodiment]

Next, the processing or operation of the present embodiment will be described with reference to FIGS. 7 to 9.

<Processing in the Learning Phase>

Figure 7:
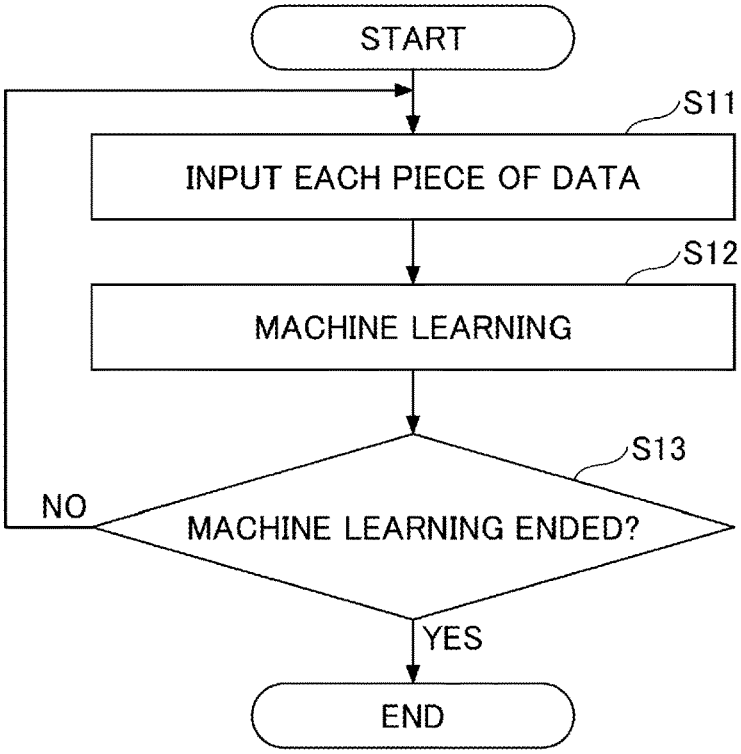
FIG. 7 is a flowchart illustrating the processing in the learning phase.

FIG. 7 is a flowchart illustrating processing in the learning phase. As illustrated in FIG. 7, the input unit 51 inputs data related to the gas consumption amount in the CA refrigerator 101 output by the sensor group 310 of FIG. 3, and inputs data of the set temperature, the set $O_2$ concentration, the set $CO_2$ concentration, and the set type and amount of the perishable product output by the setting value input device 321 as input data (S11).

Next, the learning unit 52 learns the gas consumption model 50 at the time of the operation of the CA refrigeration device by machine learning using a machine learning algorithm such as a neural network, and generates the learned gas consumption model 60 at the time of the operation of the CA refrigeration device (S12).

Next, the learning unit 52 determines whether the machine learning is completed (S13). Then, if the machine learning is not completed (S13; NO), the processing returns to step S11 and continues. On the other hand, when the machine learning ends (S13; YES), the processing in the learning phase ends.

<Processing in the Estimation Phase>

Figure 8:
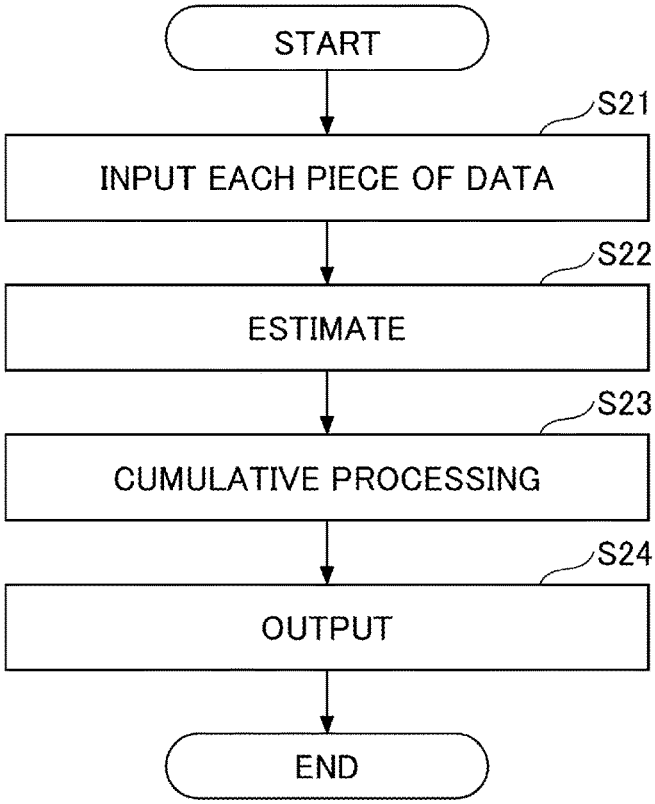
FIG. 8 is a flowchart illustrating the processing in the estimation phase.

FIG. 8 is a flowchart illustrating the processing in the estimation phase. As illustrated in FIG. 8, the input unit 61 inputs data related to the gas consumption amount in the CA refrigerator 101 output by the sensor group 310 of FIG. 3, and inputs data of the set temperature, the set O2 concentration, the set CO2 concentration, and the set type and amount of the perishable product, and furthermore the set transportation time output by the setting value input device 321 as input data (S21).

Next, the estimation unit 62 uses information on the type and amount of the perishable product stored in the CA refrigerator 101 as input data, and estimates the supply amount and the removal amount of the CA gas with respect to the CA refrigerator 101 at a predetermined time and uses the estimated amounts as output data (S22). The estimation unit 62 may estimate the supply amount or the removal amount of the CA gas.

Next, the cumulative processing unit 63 of the estimation unit 62 calculates a total gas consumption amount estimation value of the set transportation time based on the gas amount data, which is the output data acquired from the learned gas consumption model 60 at the time of the operation of the CA refrigeration device, and the set transportation time data acquired from the input unit 61 (S23).

Next, the output unit 64 acquires the total gas consumption amount estimation value calculated by the cumulative processing unit 63 and outputs the total gas consumption amount estimation value to the display 507 or the above-mentioned external device via the external device I/F 508 (S24). Thus, the processing in the estimation phase is completed.

Thus, as illustrated in FIG. 1, when the user injects a predetermined amount of CA gas from the gas injection apparatus 4 into the CA gas cylinder 104*a* in the container 2*a*, CA gas corresponding to the CA gas amount considering the transportation time can be injected based on the total gas consumption amount estimation value output in step S24. In this case, the user may inject CA gas corresponding to the CA gas amount greater than or equal to the total gas consumption amount estimation value output in step S24 within the range that can be injected into the CA gas cylinder 104*a* as a precaution.

<Ca Control>

Figure 9:
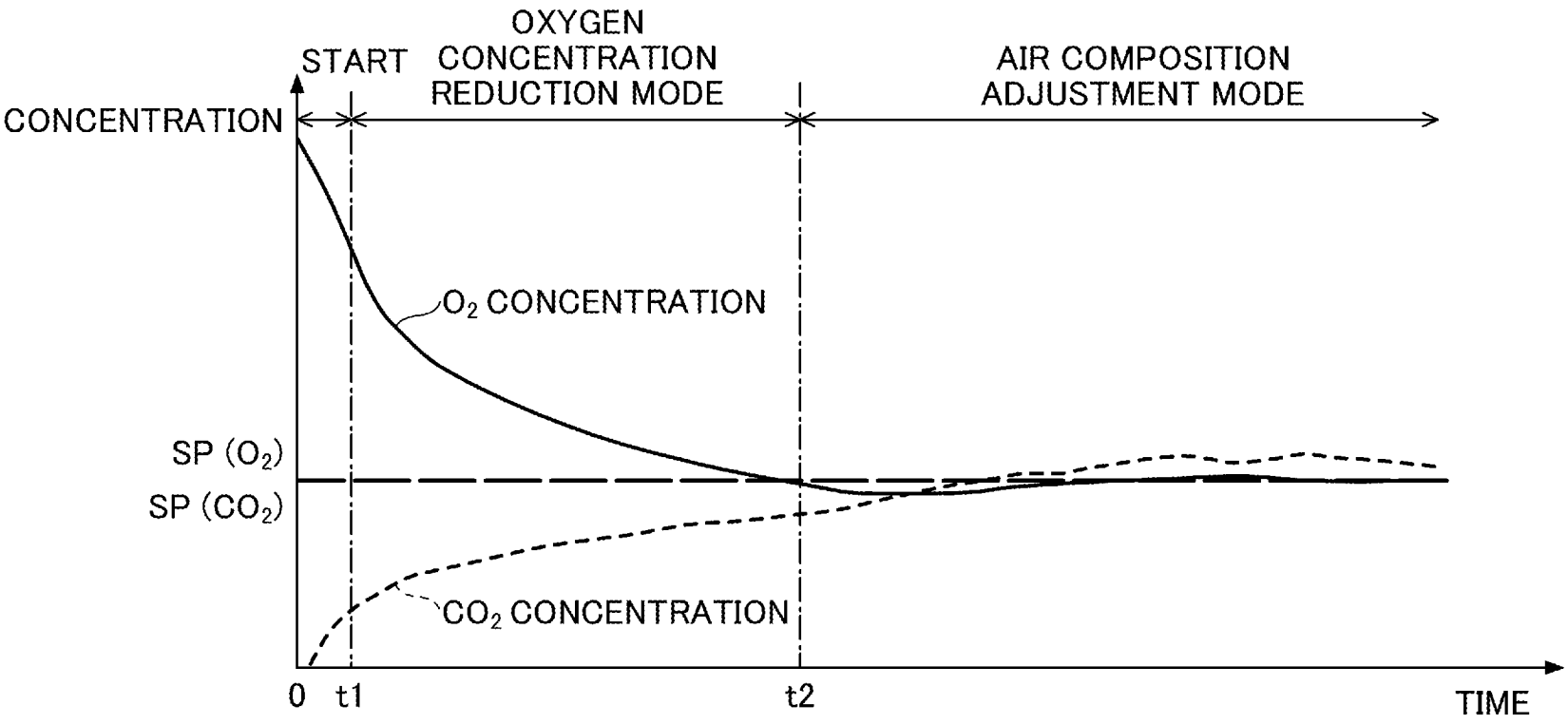
FIG. 9 is a diagram illustrating the standard processing in CA mode operation.

FIG. 9 is a diagram illustrating standard processing of a CA mode operation.

When the truck 1*a* is performing transportation, the CA refrigerator control device 322 of the CA refrigeration device 300 controls the CA refrigerator 101 in the container 2*a* to the desired air composition by transitioning from the atmospheric state to the oxygen concentration reduction mode and then to the air composition adjustment mode, as illustrated in FIG. 9.

The oxygen concentration reduction mode is an operation mode in which the $O_2$ concentration is brought close to the set concentration by the supply of low-concentration oxygen gas and the respiration of perishable products from t1 (seconds) to t2 (seconds) after the start of the CA refrigeration device 300. After starting the CA refrigeration device, the mode automatically transitions to the "oxygen concentration reduction mode".

The air composition adjustment mode is an operation mode in which the $O_2$ concentration and $CO_2$ concentration are adjusted from t2 (seconds) by the supply of low-concentration oxygen gas, ventilation by supplying outside air, and respiration of perishable products. When the $O_2$ concentration reaches the set concentration, the mode automatically transitions to the air composition adjustment mode.

Modified Example

Figure 10:
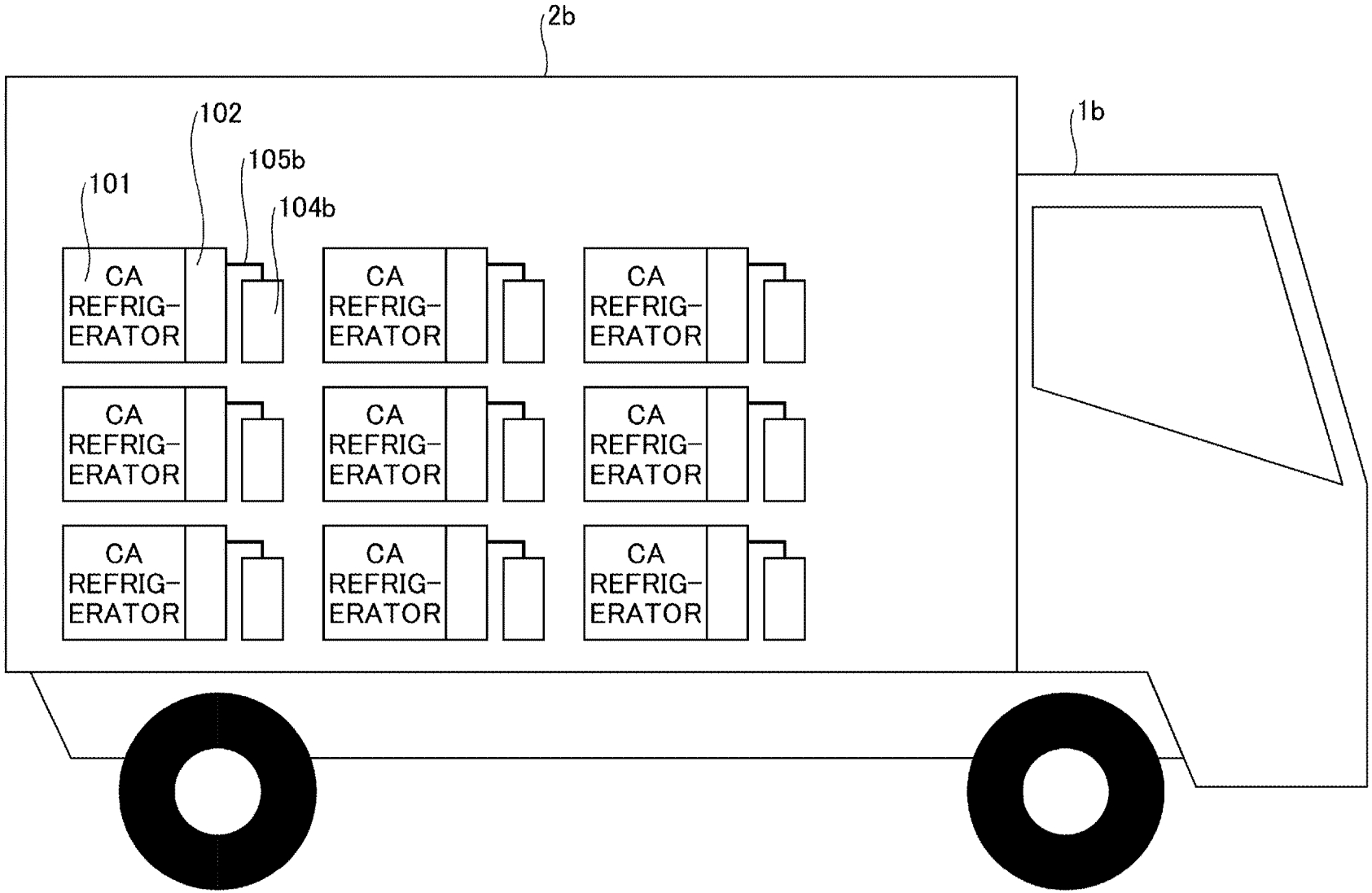
FIG. 10 is a schematic diagram of a modified example of the truck of the present embodiment.

FIG. 10 is a schematic diagram of a modified example of the truck of the present embodiment.

A truck 1*b* illustrated in FIG. 10 is an example of the truck 1 of FIG. 1. A container 2*b* mounted on the truck 1*b* is provided with a plurality of sets of the CA refrigerator 101, the CA refrigeration unit 102, a CA gas cylinder 104*b*, and a CA gas pipe 105*b*. In FIG. 10, for convenience of explanation, only one set (the CA refrigerator 101, the CA refrigeration unit 102, the CA gas cylinder 104*b*, and the CA gas pipe 105*b*) is denoted by reference numerals.

The CA refrigerator 101 and the CA refrigeration unit 102 have already been described in the above embodiment, and, therefore, descriptions thereof will be omitted.

The CA gas cylinder 104*b* is a miniaturized version of the CA gas cylinder 104*a* in FIG. 2. The CA gas cylinder 104*b* is an example of a gas processing apparatus. The CA gas pipe 105*b* is shorter than the CA gas pipe 105*a* illustrated in FIG. 2, and is used to supply CA gas from the CA gas cylinder 104*b* to the CA refrigeration unit 102.

In this modified example, the gas amount estimation apparatus 5 estimates the total gas consumption amount of each of the plurality of CA gas cylinders 104*b*.

[Main Effect of the Embodiment]

As described above, according to the first aspect of the present disclosure, the injection amount of CA gas can be optimized.

According to the second aspect, the injection amount of CA gas can be optimized by using the results learned by machine learning.

According to the third aspect, the injection amount of CA gas can be optimized by using table data.

According to the fourth aspect, the injection amount of CA gas can be optimized with higher accuracy by including, in the input data, the temperature or humidity in the CA refrigerator during the transportation of perishable products.

According to the fifth aspect, the injection amount of CA gas can be optimized with higher accuracy even when the transportation time of perishable products is relatively long, by considering the transportation time of perishable products.

According to the sixth aspect, the CA gas injection amount can be optimized with higher accuracy by estimating the CA gas supply amount or removal amount.

According to the seventh aspect, even in the case of transportation by a plurality of CA refrigerators, the number of gas amount control apparatuses for controlling the gas amount of CA gas in each of the plurality of CA refrigerators can be calculated.

According to the eighth aspect, the case where the output data is oxygen, carbon dioxide, nitrogen, or ethylene can also be accommodated.

According to the ninth aspect, it is possible to prepare a gas processing apparatus such as a CA gas cylinder in which the injection amount of CA gas is optimized.

According to a tenth aspect, it is possible to prepare a transportation container equipped with a gas processing apparatus such as a CA gas cylinder in which the injection amount of CA gas is optimized.

According to an eleventh aspect, it is possible to prepare a gas processing apparatus such as a CA gas cylinder in which the injection amount of CA gas is optimized based on the type and amount of the perishable product.

According to the twelfth aspect, the injection amount of CA gas can be optimized.

According to the thirteenth aspect, the injection amount of CA gas can be optimized by using the results learned by machine learning.

According to the fourteenth aspect, the injection amount of CA gas can be optimized by using table data.

According to the fifteenth aspect, the injection amount of CA gas can be optimized.

[Supplement]

The present invention is not limited to the above-described embodiments and modified examples, and may be the following configuration or processing (operation) as described below.

In the above embodiment, the control unit 501 calculates the CA gas supply or processing amount by using the result of machine learning of the relationship between the input data, which is information on the type and amount of perishable products stored in the CA refrigerator 101, and the true CA gas supply or processing amount, but the embodiment is not limited thereto. For example, the control unit 501 may use table data to calculate the CA gas supply amount or processing amount, based on the relationship between the input data, which is information on the type and amount of perishable products stored in the CA refrigerator 101, and the true CA gas supply or processing amount. In this case, in the table data, information on the type and amount of perishable products stored in the CA refrigerator 101 is managed in association with information on the true CA gas supply or processing amount.

In the above embodiment, the CA refrigerator 101 is provided in the container 2 mounted on the truck 1, but the embodiment is not limited thereto. For example, the CA refrigerator 101 may be a CA refrigerated delivery box. Further, the CA refrigerator 101 may be provided in a CA truck trailer equipped with a refrigeration device.

The container 2 also includes a marine container. In this case, a ship transports the marine container instead of the truck 1.

Further, the program for implementing the functions of the gas amount estimation apparatus 5 can be recorded and distributed on a recording medium such as a DVD (Digital Versatile Disc), and can be widely provided via a communication network such as the Internet.

The control unit 501 may be configured by a plurality of CPUs.

The present international application is based upon and claims priority to Japanese patent application no. 2021-160698 filed on Sep. 30, 2021, the entire contents of which are incorporated herein by reference.

INDUSTRIAL APPLICABILITY

As described above, the present disclosure is useful in the technical fields of gas amount estimation apparatuses, gas processing apparatuses, transportation containers, gas amount estimation methods, and programs.

REFERENCE SIGNS LIST

1 truck
2 container
4 gas injection apparatus
5 gas amount estimation apparatus
50 gas consumption model when driving CA refrigeration device
51 input unit
52 learning unit
53 comparison changing unit
60 learned gas consumption model when driving CA refrigeration device
61 input unit
62 estimation unit
63 cumulative processing unit
64 output unit
101 CA refrigerator
102 CA refrigeration unit (an example of a gas amount control apparatus)
103 valve
104*a* CA gas cylinder (an example of a gas processing apparatus)
104*b* CA gas cylinder (an example of a gas processing apparatus)
105*a* CA gas pipe
105*b* CA gas pipe
501 control unit

The invention claimed is:

1. A gas amount estimation apparatus comprising:

a processor and a memory storing instructions that, when executed by the processor, cause the processor to set, as input data, information relating to a type and an amount of a perishable product stored in a controlled atmosphere (CA) refrigerator; and estimate, using a learned gas consumption model, a supply amount or a processing amount of CA gas with respect to the CA refrigerator in a predetermined time and set the estimated supply amount or the estimated processing amount as output data, wherein the learned gas consumption model is generated by machine learning a relationship between the input data and true gas amount data of the supply amount or the processing amount of the CA gas as ground truth data.

2. The gas amount estimation apparatus according to claim 1, wherein the processor calculates the supply amount or the processing amount of the CA gas by using table data indicating a relationship between the input data, which is the information relating to the type and the amount of the perishable product stored in the CA refrigerator, and a true supply amount or a true processing amount of the CA gas.

3. The gas amount estimation apparatus according to claim 1, wherein the input data includes a temperature or a humidity inside the CA refrigerator during transportation of the perishable product, and the processor further estimates the supply amount or the processing amount of the CA gas based on the temperature or the humidity.

4. The gas amount estimation apparatus according to claim 1, wherein the processor further estimates the supply amount or the processing amount of the CA gas based on a transportation time of the perishable product.

5. The gas amount estimation apparatus according to claim 1, wherein the output data includes the supply amount of the CA gas supplied to the CA refrigerator to maintain the CA gas in the CA refrigerator at a predetermined concentration during transportation of the perishable product, or a removal amount of the CA gas removed from the CA refrigerator to maintain the CA gas in the CA refrigerator at the predetermined concentration during the transportation of the perishable product, and the processor estimates the supply amount of the CA gas when the supply amount of the CA gas is included in the output data, or estimates the removal amount within the processing amount of the CA gas when the removal amount of the CA gas is included in the output data.

6. The gas amount estimation apparatus according to claim 1, wherein the processor calculates a number of gas amount control apparatuses configured to control a gas amount of the CA gas in each of a plurality of CA refrigerators based on the type and the amount of the perishable product, according to the supply amount or the processing amount of the CA gas in each of the plurality of CA refrigerators.

7. The gas amount estimation apparatus according to claim 1, wherein the output data is data relating to oxygen, carbon dioxide, nitrogen, or ethylene.

8. A gas processing apparatus configured to process the CA gas with respect to the CA refrigerator, wherein a predetermined amount of the CA gas is injected in the gas processing apparatus based on the supply amount or the processing amount of the CA gas estimated by the gas amount estimation apparatus according to claim 1.

9. A transportation container comprising:

the gas processing apparatus according to claim 8.

10. The transportation container according to claim 9, further comprising:

a gas amount control apparatus configured to control a gas amount of the CA gas in the CA refrigerator based on the type and the amount of the perishable product.

11. A gas amount estimation method executed by a computer, the gas amount estimation method comprising:

setting, as input data, information relating to a type and an amount of a perishable product stored in a CA refrigerator; and estimating, using a learned gas consumption model, a supply amount or a processing amount of CA gas with respect to the CA refrigerator in a predetermined time and setting the estimated supply amount or the estimated processing amount as output data, wherein the learned gas consumption model is generated by machine learning a relationship between the input data and true gas amount data of the supply amount or the processing amount of the CA gas as ground truth data.

12. The gas amount estimation method according to claim 11, wherein the computer calculates the supply amount or the processing amount of the CA gas by using a result obtained by learning, by machine learning, a relationship between the input data, which is the information relating to the type and the amount of the perishable product stored in the CA refrigerator, and a true supply amount or a true processing amount of the CA gas.

13. The gas amount estimation method according to claim 11, wherein the computer calculates the supply amount or the processing amount of the CA gas by using table data indicating a relationship between the input data, which is the information relating to the type and the amount of the perishable product stored in the CA refrigerator, and a true supply amount or a true processing amount of the CA gas.

14. A non-transitory computer-readable recording medium storing a program that causes a computer to execute the gas amount estimation method according to claim 11.

* * * * *